US011549646B2

(12) United States Patent
Bernhardt et al.

(10) Patent No.: US 11,549,646 B2
(45) Date of Patent: Jan. 10, 2023

(54) FACILITY, METHOD FOR STORING AND LIQUEFYING A LIQUEFIED GAS AND ASSOCIATED TRANSPORT VEHICLE

(71) Applicant: L'Air Liquide, Societe Anonyme pour l'Etude et l'Exploitation des Procedes Georges Claude, Paris (FR)

(72) Inventors: Jean-Marc Bernhardt, La Buisse (FR); Fabien Durand, Voreppe (FR); Cecile Gondrand, Grenoble (FR); Veronique Grabie, Coublevie (FR)

(73) Assignee: L'Air Liquide, Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 818 days.

(21) Appl. No.: 16/330,975

(22) PCT Filed: Jul. 19, 2017

(86) PCT No.: PCT/FR2017/051964
§ 371 (c)(1),
(2) Date: Mar. 6, 2019

(87) PCT Pub. No.: WO2018/046809
PCT Pub. Date: Mar. 15, 2018

(65) Prior Publication Data

US 2019/0257475 A1 Aug. 22, 2019

(30) Foreign Application Priority Data

Sep. 6, 2016 (FR) ..... 1658258

(51) Int. Cl.
*F17C 5/02* (2006.01)
*F17C 5/04* (2006.01)

(52) U.S. Cl.
CPC ..... *F17C 5/04* (2013.01); *F17C 2201/052* (2013.01); *F17C 2201/054* (2013.01);
(Continued)

(58) Field of Classification Search
CPC ..... F17C 5/04; F17C 7/00; F17C 7/02; F17C 2227/0337; F17C 2227/0341;
(Continued)

(56) References Cited

U.S. PATENT DOCUMENTS 3,302,416 A * 2/1967 Proctor ..... F25J 1/0022 62/48.2
10,012,350 B2 7/2018 Le Bruchec et al.
(Continued)

FOREIGN PATENT DOCUMENTS

DE 10 2013 081333 A1 4/2015
DE 102013018333 A1 * 4/2015 ..... F17C 3/00
(Continued)

OTHER PUBLICATIONS

DE-102013018333-A1 Translation.*
(Continued)

*Primary Examiner* — Brian M King
(74) *Attorney, Agent, or Firm* — Justin K. Murray

(57) ABSTRACT

The invention primarily concerns a facility for storing and cooling a liquefied gas, for example a liquefied natural gas, the facility comprising at least one tank configured to contain the liquefied gas, a closed cooling circuit configured to be supplied with liquefied gas in the liquid state coming from the tank, at least one injection member configured for reinjecting cooled liquefied gas into the tank, the facility
(Continued)

being characterized in that it comprises at least one connection line configured to recover a cooled gas from at least one remote container that is separate and independent from the facility.

4 Claims, 2 Drawing Sheets

(52) U.S. Cl.
CPC ... *F17C 2221/011* (2013.01); *F17C 2221/014* (2013.01); *F17C 2221/016* (2013.01); *F17C 2221/03* (2013.01); *F17C 2221/033* (2013.01); *F17C 2223/0161* (2013.01); *F17C 2223/0169* (2013.01); *F17C 2227/0339* (2013.01); *F17C 2227/0341* (2013.01); *F17C 2227/0348* (2013.01); *F17C 2227/0351* (2013.01); *F17C 2227/0355* (2013.01); *F17C 2227/0383* (2013.01); *F17C 2265/031* (2013.01); *F17C 2265/034* (2013.01); *F17C 2265/035* (2013.01); *F17C 2265/066* (2013.01); *F17C 2270/0105* (2013.01)

(58) Field of Classification Search
CPC ..... F17C 2227/0369; F17C 2227/04; F17C 2227/042; F17C 2225/0161; F17C 2225/0169; F17C 2223/0153; F17C 2221/033; F17C 2265/033; F17C 2265/034; F25J 2290/62
See application file for complete search history.

(56) References Cited

U.S. PATENT DOCUMENTS

| | | | | |
|---|---|---|---|---|
| 2002/0038676 | A1* | 4/2002 | Siegele | A61M 25/0009 141/63 |
| 2006/0283206 | A1* | 12/2006 | Rasmussen | F04D 27/0292 62/619 |
| 2009/0211262 | A1 | 8/2009 | Lee et al. | |
| 2010/0000253 | A1* | 1/2010 | Fuchs | F25J 1/0072 62/613 |
| 2016/0216029 | A1* | 7/2016 | Ragot | F17C 5/06 |

FOREIGN PATENT DOCUMENTS

| | | |
|---|---|---|
| EP | 1 682 814 A1 | 7/2006 |
| EP | 2 775 194 | 9/2014 |
| FR | 3 028 306 A1 | 5/2016 |
| JP | 2013-87911 | 5/2013 |
| JP | 2016-520771 | 7/2016 |
| KR | 10-0875064 | 12/2008 |
| KR | 10-1537277 | 7/2015 |
| WO | 2009 066044 A2 | 5/2009 |

OTHER PUBLICATIONS

International Search Report and Written Opinion for corresponding PCT/FR2017/051964, dated Nov. 10, 2017, English translation.
French Search Report and Written Opinion for corresponding FR1658258, dated May 5, 2017.

* cited by examiner

FACILITY, METHOD FOR STORING AND LIQUEFYING A LIQUEFIED GAS AND ASSOCIATED TRANSPORT VEHICLE

CROSS-REFERENCE TO RELATED APPLICATIONS

This application is a § 371 of International PCT Application PCT/FR2017/051964, filed Jul. 19, 2017, which claims § 119(a) foreign priority to French patent application FR 1658258, filed Sep. 6, 2016.

BACKGROUND

Field of the Invention

The present invention relates to a facility for storing and cooling a liquefied gas, for example, a liquefied natural gas. Furthermore, the present invention relates to a storage method for storing a liquefied gas.

Related Art

A facility for storing liquefied natural gas is known from document U.S. Pat. No. 3,302,416 A that allows the liquefied natural gas to be stored while it is transported to another building. The cooling device disclosed in document U.S. Pat. No. 3,302,416 A comprises a plurality of compressors, a plurality of engines, and a plurality of heat exchangers configured to cool the liquefied gas coming from the tank and at least one refrigeration source outside the gas storage facility. The refrigeration source corresponds to an item of equipment that is independent relative to the compressors, exchangers, etc. forming the storage facility and allows limited amounts of stored liquefied gas to be sub-cooled in order to be able to avoid a heat gain in said facility and allows the sub-cooled liquid to be reinjected into various zones of the storage space so as to provide relatively uniform temperature conditions in the stored liquid gas with minimal disruption from vapors stratified on the liquid surface. This refrigeration source can be, for example, a container in the form of a cylinder of gas, called cycle gas.

However, the storage facility disclosed in this document comprises numerous independent components, which require numerous mutual interconnection interfaces. Furthermore, these numerous components form a large buffer volume that needs to be filled upon each start-up of each cycle. The use of an internal system enables the cycle gas that is used to operate the facility to be stored, said cycle gas being stored in another item of external equipment when it is hot and being reintroduced into the circuit of the facility once it is cool.

Furthermore, in this document, only the transport function is highlighted, there is no reference to the loading and unloading of the liquefied gas. Indeed, this document simply discloses that when the liquefied gas is transported they ensure that the pressure does not increase and therefore everything that evaporates is reliquefied. However, there is no mention of the unloading of said gas once it has reached its destination.

Liquefaction of natural gas makes its marine transportation conceivable and viable. During shipping, under the effects of thermal ingress in the storage units and of buffeting phenomena, large amounts of gas are generated by evaporation. In order to control the resulting pressure fluctuations, this evaporated gas either can be used for propulsion or can be burnt by a flare or can be reliquefied. Any transfer of liquid to a storage unit in which the pressure and temperature conditions differ from those of the original storage unit leads to the evaporation of the liquefied natural gas, for temperature (hot tank) and/or pressure (flashing of the liquid) reasons. This scenario occurs in the following situations: transfer from a supply vessel to a client, filling of a methane carrier at the terminal, refrigeration of the storage units at the end of the unladen return voyage of a methane carrier.

In particular, the aim of the present invention is to fully or partly overcome the aforementioned problems.

SUMMARY OF THE INVENTION

The present invention can involve using a facility that is particularly disclosed in document WO 2009/066044 and for which all the features are incorporated by reference in the present application. The facility can comprise at least: one cryogenic device intended to transfer heat from a cold source to a hot source via a working fluid or a cycle gas circulating through a working circuit or through a closed cycle circuit, the working circuit comprising the following in series: a portion for isothermal, or substantially isothermal, compression of the fluid, a portion for isobaric, or substantially isobaric, cooling of the fluid, a portion for isothermal, or substantially isothermal, expansion of the fluid and a portion for isobaric, or substantially isobaric, reheating of the fluid. The compression portion comprises at least two compressors disposed in series, at least one exchanger for cooling compressed fluid disposed at the output of each compressor. The expansion portion comprises at least one expansion turbine and at least one exchanger for reheating expanded fluid, with the compressors and the one or more expansion turbine(s) being driven by at least one engine, called high-speed engine. The engine comprises an output shaft, one of the ends of which supports and sets into rotation a first compressor by direct coupling and the other end of which supports and sets into rotation a second compressor or an expansion turbine by direct coupling.

In the present invention, a "high-speed engine" is understood to be an engine typically running at a rotation speed of 10,000 revolutions per minute or several tens of thousands of revolutions per minute. A low-speed engine instead runs at a speed of a few thousand revolutions per minute.

The aim of the invention is a facility for storing and cooling a liquefied gas, for example, a liquefied natural gas, the facility comprising:

- at least one tank configured to contain liquefied gas, said tank comprising at least one lower region intended to contain the liquefied gas in the liquid state, and at least one upper region intended to contain the vapors of the liquefied gas;
- at least one closed cooling circuit configured to be supplied with liquefied gas in the liquid state coming from the tank, the cooling circuit comprising at least one compressor configured to compress a cycle gas, at least one engine, at least one turbine, and at least one first heat exchanger configured to generate a heat exchange between the liquefied gas in the liquid state coming from the tank and the cycle gas, for example, nitrogen, so as to cool the liquefied gas coming from the tank when the facility is in operation; and
- at least one injection component fluidly connected to the cooling circuit via an injection pipe fluidly connecting the cooling circuit and the injection component, the injection component being configured to reinject the cooled liquefied gas into the tank, the engine being mechanically connected, on the one hand, to the compressor in order to drive the compressor and, on the other hand, to the turbine so that the turbine drives the engine, the facility being characterized in that it comprises at least one connection line configured to recover a liquefied gas to be cooled from at least one remote container, which is separate and independent from the facility, said connection line being fluidly connected to the tank of the facility.

By virtue of this configuration of the facility and particularly due to the closed and autonomous cooling circuit, a buffer volume is not required for storing cycle gas, which reduces the total fluid capacity of the circuit. Indeed, in this configuration, cooling is performed initially: the cycle gas is already at a determined and over-designed pressure in all the items of equipment of the cooling circuit.

Furthermore, this configuration is compact and space-saving, as the distance between the items of equipment of the cooling circuit is not significant. This reduced distance allows a reduced amount of cycle gas to be used and therefore avoids having to excessively increase the pressure in order to cool down to reach an operating pressure. Furthermore, as the turbine is mechanically connected to the compressor by means of the engine, the facility can operate with a single compressor, which reduces the size of the facility and the fluid connections between the various items of equipment of the cooling circuit.

Furthermore, the connection line allows cooling of a liquefied gas to be cooled that comes from a container, which is separate and independent from the facility.

In the present application and according to the invention, the term "container, which is separate and independent from the facility" will be understood to mean a container that does not form part of the facility or of the cooling circuit, for example, the container is on the same vessel, on another vessel or on land.

Moreover, the cooling device does not require valves between the compressor and the turbine, since the speed of the engine simply needs to be controlled and commanded in order to regulate the flow of coolant circulating through the first heat exchanger. Thus, the facility is particularly quick to install and commission, which is particularly advantageous when the facility must be installed on a liquefied gas transport vehicle, for example, on a vessel such as a methane carrier.

When the facility is in operation, the first heat exchanger allows liquefied gas coming from the tank to be cooled, via the cycle gas, to a temperature that is below the temperature of the liquefied gas contained in the tank. This cooling is commonly denoted "sub-cooling".

According to one feature of the invention, the facility comprises at least one bypass pipe connected to the injection pipe, said bypass pipe being configured to transfer some of the cooled liquefied gas to a remote container, which is separate and independent from the facility.

This allows at least one container, which is separate and independent, to be supplied for the use of cooled liquefied gas.

According to one feature of the invention, the supply line is at least partly coincident with the bypass pipe. Alternatively, the supply line is separate from the bypass pipe.

According to another feature of the invention, the engine is directly connected to the compressor.

According to another feature of the invention, the engine is directly connected to the turbine.

According to one feature of the invention, the facility further comprises a pump configured to supply the cooling device with liquefied gas in the liquid state coming from the tank. In other words, the cooling circuit is fluidly connected to the pump.

According to one feature of the invention, the pump is arranged in the lower region of the tank.

According to one feature of the invention, the output of the turbine is directly fluidly connected to the first heat exchanger.

According to one feature of the invention, the output of the compressor is indirectly fluidly connected to the first heat exchanger.

According to one feature of the invention, the cooling circuit further comprises a second heat exchanger configured to generate a heat exchange between the compressed cycle gas coming from the compressor and the expanded cycle gas coming from the turbine.

According to one feature of the invention, the input of the compressor is fluidly connected to the output of the turbine without an intermediate component other than the first heat exchanger and the second heat exchanger.

According to another feature of the invention, the turbine is fluidly connected to the first heat exchanger by a first connection pipe, without an intermediate component.

According to another feature of the invention, the compressor is fluidly connected to the first heat exchanger by a second connection pipe.

According to one feature of the invention, the cooling circuit comprises at least one first connection component mechanically connecting the engine to the compressor, and at least one second connection component mechanically connecting the engine to the turbine.

According to another feature of the invention, the first connection component comprises a first rotary shaft.

According to another feature of the invention, the second connection component comprises a second rotary shaft.

According to one feature of the invention, the cooling circuit is configured to operate on the basis of a Brayton cycle. In the present application, "Brayton cycle" will be understood to mean a thermodynamic cycle developed by George Brayton that generates a gas, which in the present invention is called cycle gas.

According to one feature of the invention, the cooling circuit comprises a third heat exchanger configured to generate a heat exchange between the cycle gas and a fluid at ambient temperature, for example, water or a coolant, which allows the heat from the cycle gas to be discharged outwards.

According to one feature of the invention, the injection component is arranged in the upper region of the tank. In other words, the injection component injects the cooled liquefied gas in the vapor phase, i.e. above the level of the liquefied gas in the liquid state.

By way of a variation, the injection component is arranged in the lower region of the tank. In other words, the injection component injects the cooled liquefied gas in the liquid phase, i.e. below the level of the liquefied gas in the liquid state.

According to one feature of the invention, the injection component comprises a plurality of injection nozzles arranged in series and/or in parallel.

According to one feature of the invention, the cooling circuit is configured to cool liquefied gas coming from the tank to a temperature between 35 K and 150 K, for example, equal to 110 K or 80 K.

According to another feature of the invention, the cooling circuit is configured to cool liquefied gas coming from the tank at a flow rate between 5 $m^3/h$ and 50 $m^3/h$.

According to one feature of the invention, the tank contains a liquefied gas selected from the group formed by a liquefied natural gas, or another methane-rich gas such as biomethane, nitrogen, oxygen, argon and mixtures thereof.

According to one feature of the invention, the cooling circuit contains a coolant selected from the group comprising nitrogen, argon, neon, helium and mixtures thereof.

According to one feature of the invention, the bypass pipe comprises a terminal end comprising a connector intended to be connected to a remote container.

According to one feature of the invention, the bypass pipe preferably comprises a valve, in particular an isolation valve.

A further aim of the invention is a method for using a facility according to the invention for a liquefied gas, for example, a liquefied natural gas, the method comprising at least the following steps:

- at least partially receiving liquefied gas coming from a container, which is separate and independent from the facility according to the invention, via the connection line fluidly connecting the at least one tank to the remote container, which is separate and independent from the facility;
- supplying the cooling circuit with liquefied gas coming from the tank;
- cooling the liquefied gas coming from the tank by means of the cooling circuit; and
- injecting the cooled liquefied gas into the tank by means of the injection component.

According to one feature of the invention, the method comprises a transfer step performed after the injection of the cooled liquefied gas, the transfer step comprising transferring at least some of the cooled liquefied gas to at least one remote container, which is separate and independent from said facility, by means of the injection pipe and the bypass pipe of the facility.

Advantageously, the transfer of the liquefied gas can be partial or total depending on the number of tanks of the facility and depending on the requested amount of cooled liquefied gas.

According to one feature of the invention, the facility that is used comprises at least two tanks configured to contain liquefied gas, said method according to the invention being implemented during a journey, in the course of which the tanks are full.

Following delivery, at least one tank can be empty (empty or practically empty of liquid).

According to one feature of the invention, the method comprises an additional step of refrigerating the at least one empty tank of the facility or one or more other empty container(s) of at least one other facility, the refrigeration step comprising:

- transferring the cooled liquefied gas remaining in the at least one tank of the facility to one or more empty container(s) of at least one other facility; or
- transferring the cooled liquefied gas remaining in at least one container of at least one other facility to the at least one empty tank of the facility; or
- transferring, when the facility comprises at least two tanks, one of which is empty and the other one of which is not empty, the cooled liquefied gas remaining in the non-empty tank to the empty tank.

This means that, particularly for the purposes of a journey of the facility (on a ship), instead of keeping one or more tank(s) empty, liquefied gas is transferred from a non-empty tank to one or more other empty tank(s), particularly to keep them cool.

Advantageously, this refrigeration step is performed after unloading the liquefied gas and before the subsequent filling of the one or more tank(s) of the facility or of the one or more container(s) of at least one other facility.

Advantageously, this refrigeration step is performed continuously to avoid leaving the tanks empty and hot and to allow the thermal load to be equalized in order to limit any losses associated with the final vaporization peak of liquefied gas.

The advantage is to thus only maintain liquid in the tanks of a ship that enables the return voyage, without considering the cooling losses on arrival.

In the end, this allows the amount of liquid to be increased that is transported to the destination in the same ship.

According to one feature of the invention, the refrigeration step is performed during a journey, in the course of which at least one of the tanks is empty.

Furthermore, a further aim of the present invention is a transport vehicle, for example, a transport vessel, for transporting a liquefied gas, for example, a liquefied natural gas, the transport vehicle being characterized in that it comprises a facility according to the invention.

The embodiments and the variations mentioned above can be taken separately or according to any possible technical combination.

BRIEF DESCRIPTION OF THE FIGURES

The invention will be better understood from the following description, which relates to embodiments according to the present invention, which are provided by way of non-limiting examples and are explained with reference to the accompanying schematic drawings, in which.

DETAILED DESCRIPTION OF THE INVENTION

Figure 1:
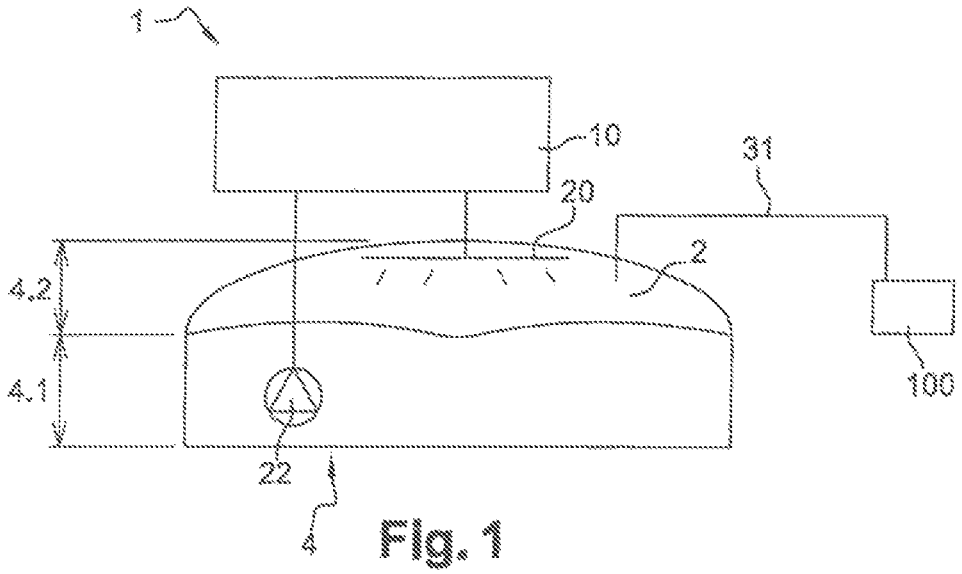
FIG. 1 is a schematic view of a facility according to a first embodiment of the invention.

As shown in FIG. 1, the facility 1 according to a first embodiment comprises a tank 4 comprising a lower region 4.1 intended to contain liquefied gas 2 in the liquid state and an upper region 4.2 intended to contain the vapors of the liquefied gas 2. Furthermore, the facility 1 comprises a cooling circuit 10, particularly shown in FIG. 2. Preferably, the cooling circuit 10 is located outside the tank, i.e. the liquefied gas is (only) cooled outside the tank. In other words, the liquefied gas is taken from the tank, is cooled outside the tank and is then reinjected into the tank in the cooled state. The cooling device 10 is connected to the fluid inside the tank 4 via a sampling pipe that penetrates the tank. The tank 4 is equipped with a pump 22 that allows the liquefied gas in the liquid state to be brought to the cooling circuit in order to be cooled and with at least one injection component 20 that allows the cooled liquefied gas to be reinjected into the tank 4. The injection component comprises a return pipe that connects the cooling device (outside the tank) to the inside of the tank 4 and comprises the injection component 20. Advantageously, the injection component 20 can comprise a plurality of nozzles.

Furthermore, and as shown in FIG. 1 according to a first embodiment of the facility, the facility 1 comprises a connection line 31 configured to route gas to be liquefied from at least one remote container 100, which is separate and independent from the facility 1, to the tank of the facility.

Figure 3:
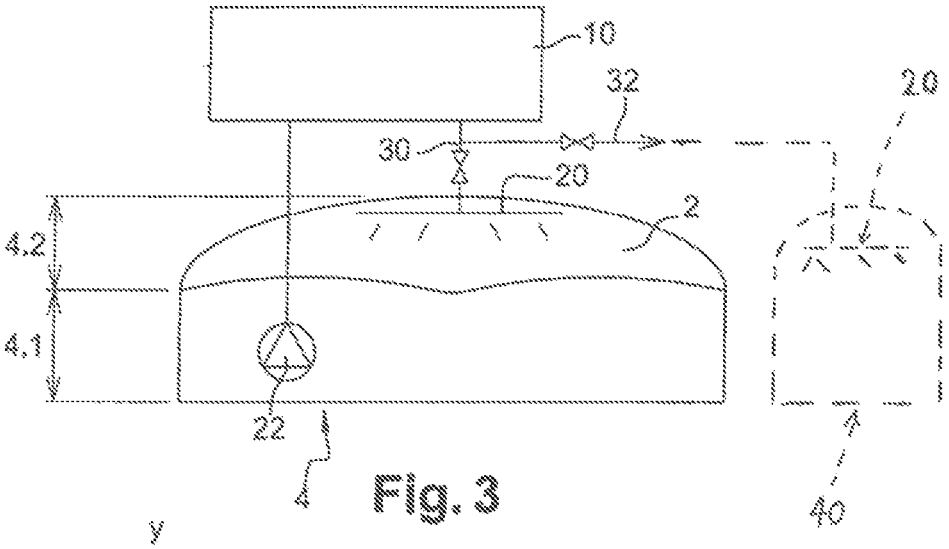
FIG. 3 is a schematic view of a facility according to a variation of the first embodiment of the invention.

According to a variation of the first embodiment shown in FIG. 3, the facility 1 comprises an injection pipe 30 fluidly connecting the cooling circuit and the injection component 20, and at least one bypass pipe 32 connected to the injection pipe 30 and intended to transfer some of the cooled liquefied gas 2 to a remote container (not shown), which is separate and independent from the facility 1.

For example, another tank 4 is shown as a dotted line in FIG. 3. This tank 4, of the same facility or of another facility, can be supplied with liquefied gas via the bypass pipe 32 and a respective injection component 20, where applicable.

Of course, in another variation (not shown), the bypass pipe 32 and the connection line 31 can be installed on the same facility.

Figure 2:
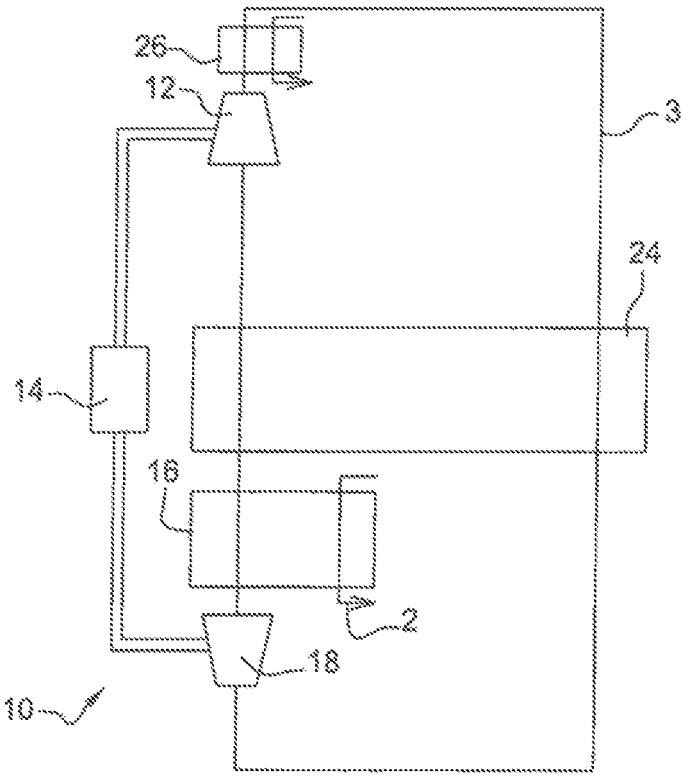
FIG. 2 is a schematic view of a cooling device forming part of the facility of FIG. 1.

As shown in FIG. 2, and irrespective of the configuration of the facility 1, the cooling circuit 10 is closed and autonomous and is configured to be supplied with liquefied gas 2 in the liquid state coming from the tank 4. The cooling circuit 10 comprises at least one compressor 12 configured to compress a cycle gas 3, at least one engine 14, at least one turbine 18, and at least one first heat exchanger 16 configured to generate a heat exchange between the liquefied gas 2 and the cycle gas.

As can be seen in FIG. 2, the engine 14 is mechanically connected, on the one hand, to the compressor 12 in order to drive the compressor 12 and, on the other hand, to the turbine 18 so that the turbine 18 drives the engine 14.

The cooling circuit 10 further comprises a second heat exchanger 24 configured to generate a heat exchange between the compressed cycle gas 3 and the expanded cycle gas 3, as shown in FIG. 2.

The cooling circuit 10 further comprises a third heat exchanger 26 configured to generate a heat exchange between the compressed cycle gas 3 and water or air or any other coolant coming from an external source.

In the event that one or more of the tank(s) 4 contain(s) liquefied natural gas on a vehicle, in particular a ship, the natural gas that vaporizes can be used as fuel for an engine of the vehicle and any excess gas is burnt in a flare, for example.

Figure 4A:
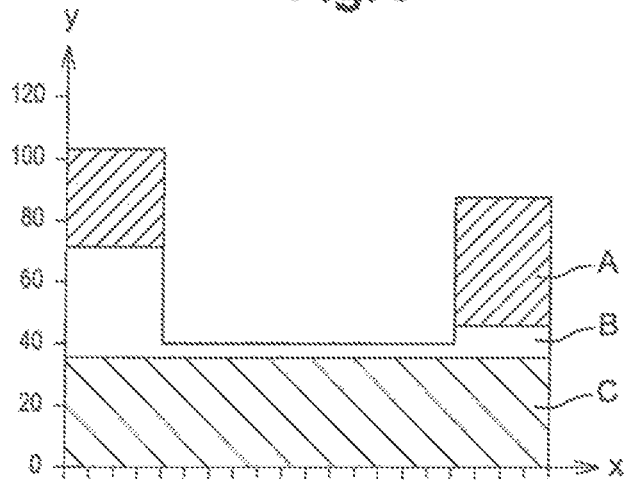
FIG. 4A is a simplified graphic representation showing the distribution of the consumption of the natural gas vaporized on a ship over time toward the engine, toward a flare and toward a reliquefaction system according to the prior art.

FIG. 4A shows the distribution of the consumption (axis of ordinates y in tons per day) of the natural gas vaporized on a ship over time (axis of abscissae x) toward the engine (C: section with horizontal shading), toward the flare (A: section with inclined shading) and toward the reliquefaction system (B: section without shading) for a known facility.

Figure 4B:
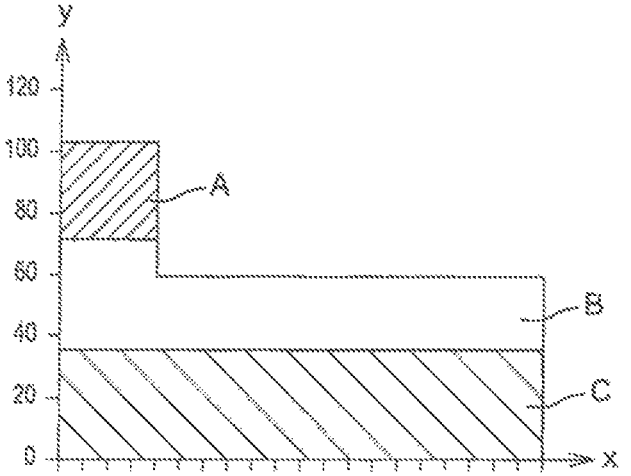
FIG. 4B is a simplified graphic representation similar to that of FIG. 4A showing the distribution of the consumption of the natural gas vaporized on a ship over time toward the engine, toward a flare and toward a reliquefaction system according to an embodiment of the invention.

FIG. 4B shows the distribution of the consumption in tons per day (y axis) of the natural gas vaporized on a ship over time (x axis) toward the engine (C), toward the flare (A) and toward the reliquefaction system (B) for the facility according to the invention.

It can be seen that, according to the known facility (FIG. 4A), losses of vaporized gas remain at the end of the journey since the engines and the facility are not designed to recover this gas. However, in FIG. 4B, by virtue of the facility according to the invention, there is no longer a peak at the end of the journey, the losses are minimal, particularly by virtue of the system for refrigerating the tanks.

Of course, the invention is not limited to the embodiments described and shown in the accompanying figures. Modifications are still possible, particularly in terms of the constitution of the various elements or by substitution of equivalent techniques, yet without departing from the scope of protection of the invention.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing i.e. anything else may be additionally included and remain within the scope of "comprising." "Comprising" is defined herein as necessarily encompassing the more limited transitional terms "consisting essentially of" and "consisting of"; "comprising" may therefore be replaced by "consisting essentially of" or "consisting of" and remain within the expressly defined scope of "comprising".

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

What is claimed is:

1. A method of using a facility for storing and cooling a liquefied gas, comprising the steps of:

providing a facility comprising:

at least one tank configured to contain liquefied gas, said tank comprising at least one lower region adapted and configured to contain the liquefied gas in the liquid state, and at least one upper region adapted and configured to contain the vapors of the liquefied gas;

at least one closed cooling circuit adapted and configured to be supplied with liquefied gas in the liquid state coming from the tank, the cooling circuit comprising at least one compressor adapted and configured to compress a cycle gas, at least one engine, at least one turbine, and at least one first heat exchanger adapted and configured to generate a heat exchange between the liquefied gas in a liquid state coming from the tank and the cycle gas so as to cool the liquefied gas coming from the tank when the facility is in operation;

at least one injection component fluidly connected to the cooling circuit via an injection pipe, the injection component being adapted and configured to reinject the cooled liquefied gas into the tank; and at least one connection line adapted and configured to recover a gas to be cooled from at least one remote container, which is separate and independent from said facility, said at least one connection line being fluidly connected to the tank of the facility, wherein the engine is mechanically connected to the compressor in order to drive the compressor and also to the turbine so that the turbine drives the engine;

at least partially receiving liquefied gas coming from a first remote container, which is separate and independent from the facility, via the connection line that fluidly connects the at least one tank to the remote container, the first remote container being separate and independent from the facility;

supplying the cooling circuit with liquefied gas coming from the tank;

cooling the liquefied gas coming from the tank with the cooling circuit; and injecting the cooled liquefied gas into the tank with the injection component;

transferring at least some of the cooled liquefied gas to the remote container with the injection pipe; and transferring cooled liquefied gas remaining in the at least one tank to one or more empty remote containers which are separate and independent from the facility.

2. A method of using a facility for storing and cooling a liquefied gas, comprising the steps of:

providing a first facility comprising:

at least one tank configured to contain liquefied gas, said tank comprising at least one lower region adapted and configured to contain the liquefied gas in the liquid state, and at least one upper region adapted and configured to contain the vapors of the liquefied gas;

at least one closed cooling circuit adapted and configured to be supplied with liquefied gas in the liquid state coming from the tank, the cooling circuit comprising at least one compressor adapted and configured to compress a cycle gas, at least one engine, at least one turbine, and at least one first heat exchanger adapted and configured to generate a heat exchange between the liquefied gas in a liquid state coming from the tank and the cycle gas so as to cool the liquefied gas coming from the tank when the facility is in operation;

at least one injection component fluidly connected to the cooling circuit via an injection pipe, the injection component being adapted and configured to reinject the cooled liquefied gas into the tank; and at least one connection line adapted and configured to recover a gas to be cooled from at least one remote container, which is separate and independent from said facility, said at least one connection line being fluidly connected to the tank of the facility, wherein the engine is mechanically connected to the compressor in order to drive the compressor and also to the turbine so that the turbine drives the engine;

providing a second facility comprising:

at least one tank configured to contain liquefied gas, said tank comprising at least one lower region adapted and configured to contain the liquefied gas in the liquid state, and at least one upper region adapted and configured to contain the vapors of the liquefied gas;

at least one closed cooling circuit adapted and configured to be supplied with liquefied gas in the liquid state coming from the tank, the cooling circuit comprising at least one compressor adapted and configured to compress a cycle gas, at least one engine, at least one turbine, and at least one first heat exchanger adapted and configured to generate a heat exchange between the liquefied gas in a liquid state coming from the tank and the cycle gas so as to cool the liquefied gas coming from the tank when the facility is in operation;

at least one injection component fluidly connected to the cooling circuit via an injection pipe, the injection component being adapted and configured to reinject the cooled liquefied gas into the tank; and at least one connection line adapted and configured to recover a gas to be cooled from at least one remote container, which is separate and independent from said facility, said at least one connection line being fluidly connected to the tank of the facility, wherein the engine is mechanically connected to the compressor in order to drive the compressor and also to the turbine so that the turbine drives the engine, at least one of the at least one tank of the second facility being empty;

at least partially receiving liquefied gas coming from a first remote container, which is separate and independent from the first and second facilities, via the connection line that fluidly connects the at least one tank of the first facility to the first remote container, the first remote container being separate and independent from the facility;

supplying the cooling circuit of the first facility with liquefied gas coming from the tank of the first facility;

cooling the liquefied gas coming from the tank of the first facility with the cooling circuit of the first facility, thereby producing cooled liquefied gas; and injecting the cooled liquefied gas into the tank of the first facility with the injection component of the first facility;

transferring at least some of the cooled liquefied gas to the first remote container with the injection pipe of the first facility; and transferring cooled liquefied gas remaining in the first remote container to the at least one empty tank of the second facility.

3. A method of using a facility for storing and cooling a liquefied gas, comprising the steps of:

providing a facility comprising at least one tank configured to contain liquefied gas, said tank comprising at least one lower region adapted and configured to contain the liquefied gas in the liquid state, and at least one upper region adapted and configured to contain the vapors of the liquefied gas;

at least one closed cooling circuit adapted and configured to be supplied with liquefied gas in the liquid state coming from the tank, the cooling circuit comprising at least one compressor adapted and configured to compress a cycle gas, at least one engine, at least one turbine, and at least one first heat exchanger adapted and configured to generate a heat exchange between the liquefied gas in a liquid state coming from the tank and the cycle gas so as to cool the liquefied gas coming from the tank when the facility is in operation;

at least one injection component fluidly connected to the cooling circuit via an injection pipe, the injection component being adapted and configured to reinject the cooled liquefied gas into the tank; and at least one connection line adapted and configured to recover a gas to be cooled from at least one remote container, which is separate and independent from said facility, said at least one connection line being fluidly connected to the tank of the facility, wherein the engine is mechanically connected to the compressor in order to drive the compressor and also to the turbine so that the turbine drives the engine;

at least partially receiving liquefied gas coming from a first remote container, which is separate and independent from the facility, via the connection line that fluidly connects the at least one tank to the remote container, the first remote container being separate and independent from the facility;

supplying the cooling circuit with liquefied gas coming from the tank;

cooling the liquefied gas coming from the tank with the cooling circuit; and injecting the cooled liquefied gas into the tank with the injection component;

transferring at least some of the cooled liquefied gas to a second remote container with the injection pipe, the second remote container being empty; and transferring cooled liquefied gas remaining in the first remote tank to the second remote tank.

4. A method of using a facility for storing and cooling a liquefied gas, comprising the steps of:

providing a first facility comprising:

at least one tank configured to contain liquefied gas, said tank comprising at least one lower region adapted and configured to contain the liquefied gas in the liquid state, and at least one upper region adapted and configured to contain the vapors of the liquefied gas;

at least one closed cooling circuit adapted and configured to be supplied with liquefied gas in the liquid state coming from the tank, the cooling circuit comprising at least one compressor adapted and configured to compress a cycle gas, at least one engine, at least one turbine, and at least one first heat exchanger adapted and configured to generate a heat exchange between the liquefied gas in a liquid state coming from the tank and the cycle gas so as to cool the liquefied gas coming from the tank when the facility is in operation;

at least one injection component fluidly connected to the cooling circuit via an injection pipe, the injection component being adapted and configured to reinject the cooled liquefied gas into the tank; and at least one connection line adapted and configured to recover a gas to be cooled from at least one remote container, which is separate and independent from said facility, said at least one connection line being fluidly connected to the tank of the facility, wherein the engine is mechanically connected to the compressor in order to drive the compressor and also to the turbine so that the turbine drives the engine;

providing a second facility comprising:

at least one tank configured to contain liquefied gas, said tank comprising at least one lower region adapted and configured to contain the liquefied gas in the liquid state, and at least one upper region adapted and configured to contain the vapors of the liquefied gas;

at least one closed cooling circuit adapted and configured to be supplied with liquefied gas in the liquid state coming from the tank, the cooling circuit comprising at least one compressor adapted and configured to compress a cycle gas, at least one engine, at least one turbine, and at least one first heat exchanger adapted and configured to generate a heat exchange between the liquefied gas in a liquid state coming from the tank and the cycle gas so as to cool the liquefied gas coming from the tank when the facility is in operation;

at least one injection component fluidly connected to the cooling circuit via an injection pipe, the injection component being adapted and configured to reinject the cooled liquefied gas into the tank; and at least one connection line adapted and configured to recover a gas to be cooled from at least one remote container, which is separate and independent from said facility, said at least one connection line being fluidly connected to the tank of the facility, wherein the engine is mechanically connected to the compressor in order to drive the compressor and also to the turbine so that the turbine drives the engine, at least one of the at least one tank of the second facility being empty;

at least partially receiving liquefied gas coming from a first remote container, which is separate and independent from the first and second facilities, via the connection line that fluidly connects the at least one tank of the first facility to the first remote container, the first remote container being separate and independent from the first facility;

supplying the cooling circuit with liquefied gas coming from the at least one tank of the first facility;

cooling the liquefied gas coming from the at least one tank of the first facility with the cooling circuit of the first facility;

injecting the cooled liquefied gas into the tank of the first facility with the injection component of the first facility; and transferring at least some of the cooled liquefied gas to a second remote container with a bypass pipe connected to the injection pipe of the first facility; and transferring cooled liquefied gas remaining in the at least one tank of the first facility to a second remote container separate and independent of the first and second facilities and which is empty before transfer to the cooled liquefied gas.

* * * * *